US006402555B1

(12) United States Patent
Garcia et al.

(10) Patent No.: US 6,402,555 B1
(45) Date of Patent: Jun. 11, 2002

(54) INCANDESCENT LAMP SOCKET WITH INTEGRAL FILTER

(75) Inventors: Ismael Garcia, Chicago; John C. Pakledinaz, Mundelein, both of IL (US)

(73) Assignee: Christiana Industries, LLC, Chicago, IL (US)

( * ) Notice: Subject to any disclaimer, the term of this patent is extended or adjusted under 35 U.S.C. 154(b) by 0 days.

(21) Appl. No.: 09/557,685

(22) Filed: Apr. 25, 2000

(51) Int. Cl.[7] ..... H01R 13/66
(52) U.S. Cl. ..... 439/620; 439/611; 439/699.2
(58) Field of Search ..... 439/620, 611, 439/619, 699.2

(56) References Cited

U.S. PATENT DOCUMENTS

| | | | | |
|---|---|---|---|---|
| 4,005,334 A | | 1/1977 | Andrews | 315/208 |
| 4,166,236 A | | 8/1979 | Andrews | 315/200 R |
| 4,375,311 A | | 3/1983 | Feldman | 439/487 |
| 4,435,671 A | | 3/1984 | Wouk | 315/200 R |
| 4,572,600 A | | 2/1986 | Nieman | 439/92 |
| 4,629,943 A | | 12/1986 | Ponce, Jr. | 315/200 R |
| 4,747,789 A | | 5/1988 | Gliha | 439/620 |
| 5,164,873 A | | 11/1992 | Krantz et al. | 361/56 |
| 5,961,204 A | * | 10/1999 | Martich et al. | 362/295 |
| 6,075,318 A | * | 6/2000 | Noll et al. | 439/699.2 |

FOREIGN PATENT DOCUMENTS

| | | |
|---|---|---|
| EP | 0193661 | 9/1986 |
| JP | 9106860 | 4/1997 |

* cited by examiner

*Primary Examiner*—Tulsidas Patel
(74) *Attorney, Agent, or Firm*—Greer, Burns & Crain, Ltd

(57) ABSTRACT

An incandescent lamp socket having an integral, self-contained current filtering device, such as a diode, is formed of a dielectric body having a lamp base receiving socket in one end thereof, a pair of channels extending from the socket to the other end of the body, a lamp base contact engaging terminal in one of the channels and, in the other channel, a lamp base contact engaging terminal, a power lead terminal spaced from the lamp based contact engaging terminal and a current filtering device, i.e., a diode, disposed between and electrically connected to the two terminals. The current filtering device is thus mounted in series circuit with a lamp fitted in the socket body to prolong the service life of the lamp and to protect the lamp and other electrical components in series circuit with the lamp from electrical transients.

9 Claims, 1 Drawing Sheet

INCANDESCENT LAMP SOCKET WITH INTEGRAL FILTER

FIELD OF THE INVENTION

The invention relates to sockets for incandescent light bulbs or lamps having a self-contained, integral current filtering device, such as a diode, capacitor, fuse or the like, preferably a diode.

BACKGROUND

The use of a diode in series with the filament of an incandescent lamp operated on alternating current increases the life of the lamp, requiring only an increase in the lamp's wattage rating to produce a lumen output equivalent to the lamp previously used. The diode provides half wave rectified direct current to the lamp filament.

One approach to using a diode with a lamp is to install the diode in a disk shaped support which is positionable within the lamp socket with one contact surface in electrical contact with the center contact on the socket and another contact surface in electrical contact with the center contact of the lamp. The diode is positioned within the diode disk and is connected between the two contact surfaces. To facilitate proper alignment of the diode disk contact surfaces with the lamp and socket center contacts, the disk may be glued to the base of the lamp to allow the disk to travel with the lamp as it is screwed into the socket. See, for example, U.S. Pat. Nos. 4,435,671 and 4,629,943.

Diodes are also employed in series circuit with incandescent lamps in series circuits including a lamp and other electrical components, such as motors and generators, for purposes of suppressing electrical transients. Lamps typically draw a high in-rush current when initially energized, and the use of a diode in the circuit suppresses or limits the in-rush current so as not to overload the lamp and other electrical components in series with the lamp. Also, various electrical components such as motors and generators can produce large current spikes which can damage or destroy the lamp or lamps and other components in the series circuit. In this case, a diode is customarily incorporated in an electrical connector.

In other cases, the diode may simply be a free-standing element on a printed circuit board.

In all of these examples, the diode is an extraneous, separate, stand-alone element.

SUMMARY OF THE INVENTION

The object of the invention is to integrate a diode or other current filtering device within a circuit component, and more particularly within an incandescent lamp socket, to protect the lamp and the electrical components in series circuit with the lamp and to prolong the service life of the lamp.

Another object of the invention is to provide a lamp socket for miniature lamps that are employed in series circuit with other electrical components, e.g., as indicator lights for audio and video equipment, in household appliances, in gaming machines, etc.

A further object is to provide a diode containing lamp socket that, even in a miniature size, is highly resistant to damage when subjected to shock and vibration.

A still further object is to provide a diode containing lamp socket that is economical and practical to produce and convenient to use.

In accordance with the invention, a lamp socket is comprised of a body of dielectric material having a lamp base receiving opening or socket at one end thereof and a pair of spaced parallel lead chambers or channels extending from the socket opening to the other end of the body, an electrical terminal in one chamber adjacent the socket end thereof for reception of and electrical connection with one of the contact terminals on a lamp and for attachment thereto of an electrical lead, and in the other chamber, a first electrical terminal adjacent the socket end thereof for reception of and electrical connection with the other one of the contact terminals on the lamp, a second terminal spaced away from the first terminal for attachment thereto of an electrical lead, and a diode or other current filtering device disposed between, mounted on and electrically connected in series circuit with said first terminal and said second terminal.

The lamp socket of the invention is practical, economical to produce and easy to use. When employed in a circuit, the socket prolongs the service life of the lamp and protects the lamp and electrical components in series circuit therewith from detrimental electrical transients.

These and other objects and advantages of the invention will become apparent from the following detailed description as considered in conjunction with the accompanying drawings.

DETAILED DESCRIPTION OF THE PREFERRED EMBODIMENT

Figure 1:
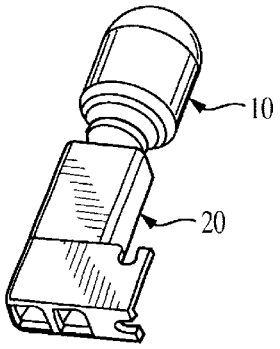
FIG. 1 is a perspective view at substantially fall scale of a miniature lamp mounted in one embodiment of a miniature lamp socket provided in accordance with the invention.

The following is a detailed description of an embodiment of the invention presently deemed by the inventors to be the best mode of carrying out the invention. FIG. 1 illustrates, substantially at full scale, a miniature light bulb or lamp 10 of the wedge base type and a socket 20 for the lamp as provided in accordance with the invention.

Figure 2:
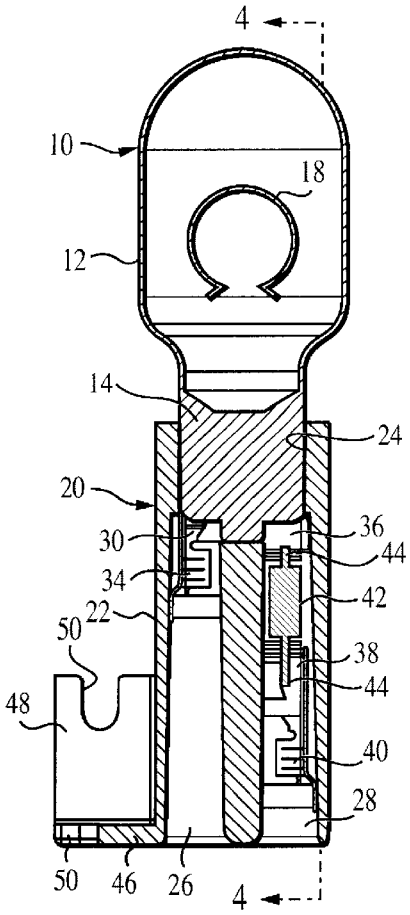
FIG. 2 is a central vertical section, on a greatly magnified scale, of the lamp and lamp socket illustrated in FIG. 1.
Figure 3:
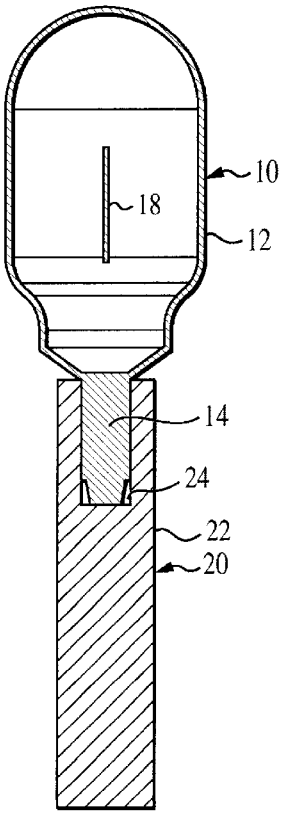
FIG. 3 is a central vertical section of the lamp and lamp socket taken at a right angle to the section of FIG. 2.
Figure 4:
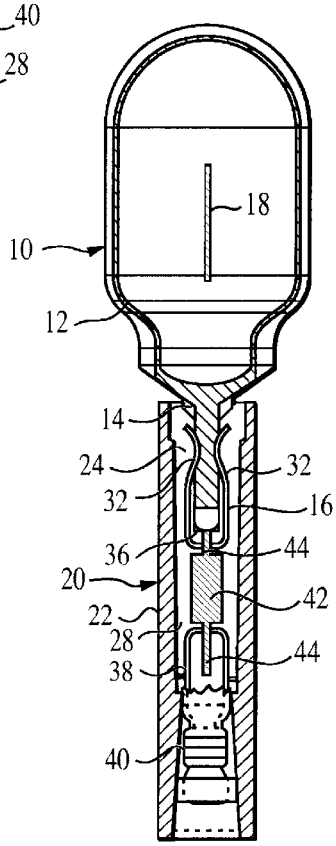
FIG. 4 is a vertical section taken substantially along the line 4—4 in FIG. 2.

As illustrated in FIGS. 2–4, the lamp 10 has a transparent or translucent envelope 12, a rectangular base 14 having a pair of contacts 16 on opposite sides thereof, adjacent the respective ends of the base, and a filament 18 within the envelope connected at its ends in manners known in the art (but not shown) to respective ones of the contacts 16.

The socket 20 comprises a dielectric body 22, suitably a molded plastic, having a rectangular opening 24 at its upper end defining a socket of a size and shape to conformably receive the rectangular base 14 of the lamp 10. Extending downwardly from the opening 24 are a pair of spaced parallel downwardly open chambers or channels 26 and 28 adapted to receive the terminals and the leads for supplying power to the lamp. As shown in FIG. 1, the chambers are preferably square.

The channel 26 adjacent its upper end contains a clip type terminal 30. As is shown in FIG. 4 in connection with terminal 36, clip type terminals are comprised of opposed spring fingers 32 adapted to grasp and hold the base 14 of the lamp and to make firm physical and electrical contact with one of the contacts 16 on the lamp. The base of the lamp preferably has indentations or recesses therein for receiving the end portions of the fingers 32 of the terminal to secure the lamp in the socket in sound electrical engagement with the lamp contact. The lamp is thus securely mounted within the socket to withstand shock and vibration. Within the channel 26, the terminal 30 includes a crimp section 34 for receiving a power lead (not shown). The power lead may for example comprise a flexible conductor for wiring to a power source and/or other electrical component or a stiff conductor for mounting the socket to a printed circuit board.

The channel 28 adjacent its upper end contains a clip type terminal 36 similar to the terminal 30 and including opposed spring fingers 32 adapted to grasp and hold the lamp base 14 and to make firm physical and electrical engagement with the other one of the lamp contacts 16. The terminal 36 is preferably U-shaped and provided with a small recess or hole in the bight portion of the U.

The channel 28 also contains a second terminal 38 spaced downwardly from, and electrically isolated from, the terminal 36. Terminal 38 may be comprised at its upper end of an inverted U-shaped portion having a small recess or hole in its bight portion and a leg portion extending downwardly within the channel and having a crimp section 40 at its lower end for securing a power lead to the terminal 38. Mounted between the terminals 36 and 38 is a current filtering device, preferably a diode 42. The diode has a body portion and a conductive connector post 44 extending from each end of the body. Each post is conformably received in a recess or hole in the bight portion of a respective one of the two terminals 36 and 38 in secure physical engagement and sound electrical contact with the two terminals. The diode or other current filtering device is thereby mounted in series circuit with the terminals 36 and 38 and the lamp 10. Additionally, the diode is securely held in place within the channel 28 by the terminals 36 and 38 to withstand shock and vibration and to insure that the diode always remains in sound electrical contact with the terminals 36 and 38 and does not become disassociated from them.

Being dielectric, the body 22 insulates the contained electrical elements or components from the ambient environment and isolates the terminal and lead in the channel 26 from the electrical elements or components in channel 28.

The body 22 of the socket further includes, at its lower end, a lateral extension 46 bearing and/or comprising an L-shaped mounting bracket 48 having a mounting slot 50 in each of its two legs to facilitate mounting of the socket in desired orientation on either a generally vertical surface or a generally horizontal surface.

The lamp socket of the invention may be assembled automatically or semi-automatically. It is easy to make and easy to install. The diode or other filtering device is self-contained within and integral with the socket and eliminates the prior art requirement for a separate, stand-alone diode or filter element. In use, the diode prolongs the service life of the lamp and suppresses transients that would otherwise damage the lamp and other electrical components in series circuit with the lamp.

The objects and advantages of the invention have therefore been shown to be attained in a convenient, practical, economical and facile manner.

While only a presently preferred embodiment of the invention has been herein illustrated and described, it is to be appreciated that various changes, rearrangements and modifications may be made therein without departing from the scope of the invention as defined by the appended claims.

What is claimed is:

1. An incandescent lamp socket with an integral current filtering device comprising:

a body member having a lamp receiving socket at one end thereof and a pair of channels extending from the socket to the other end of the body member, said socket being adapted to receive a lamp base having a pair of spaced contacts thereon, a terminal in one of the channels adjacent the socket end thereof for engagement with one of the contacts on the lamp base, a first terminal in the other one of the channels adjacent the socket end thereof for engagement with the other one of the contacts on the lamp base, a second terminal in the other one of said channels spaced away from the first terminal in the other one of said channels, and a current filtering device in the other one of said channels extending between and electrically connected with said first and second terminals.

2. A lamp socket as set forth in claim 1, including means on the terminal in said one channel and the second terminal in said other channel for reception of respective ones of a pair of power leads extending from the respective terminal through the respective channel to said other end of said body member.

3. A lamp socket as set forth in claim 2 wherein the body member is dielectric, insulates the components in the channels from the ambient environment and electrically isolates the components in said one channel from the components in said other channel.

4. A lamp socket as set forth in claim 1 wherein said current filtering device and said first and second terminals in said other channel have means thereon for preventing displacement of said current filtering device from said terminals.

5. A lamp socket as set forth in claim 1 wherein the current filtering device comprises a diode.

6. A lamp socket as set forth in claim 5 wherein the diode has a body portion and a connector post extending from each end of the body portion and said first and second terminals in said other channel have recesses therein for conformably receiving a respective one of said posts and preventing displacement of said diode from said terminals.

7. An incandescent lamp socket with an integral current filtering device comprising:

a body member having a lamp receiving socket at one end thereof and a pair of channels extending from the socket to the other end of the body member, said socket being adapted to receive a lamp base having a pair of spaced contacts thereon, a terminal in one of the channels adjacent the socket end thereof for engagement with one of the contacts on the lamp base, a first terminal in the other one of the channels adjacent the socket end thereof for engagement with the other one of the contacts on the lamp base, a second terminal in the other one of said channels spaced away from the first terminal in the other one of said channels, and a current filtering device in the other one of said channels extending between and electrically connected in series circuit with said first and second terminals, said current filtering device having a body portion and a connector post extending from each end of the body portion, said first and second terminals in said other channel having means thereon conformably engaging a respective one of said posts for preventing displacement of said current filtering device from said terminals.

8. A lamp socket as set forth in claim 7 wherein the body member is dielectric, insulates the components in said channels from the ambient environment and electrically isolates the terminal in said one channel from the terminals and current filtering device in said other channel.

9. A lamp socket as set forth in claim 7, including means on the terminal in said one channel and the second terminal in said other channel for reception of respective ones of a pair of power leads extending from the respective terminal through the respective channel to said other end of said body member.

* * * * *